US010826186B2

(12) United States Patent
Irion, II

(10) Patent No.: US 10,826,186 B2
(45) Date of Patent: Nov. 3, 2020

(54) SURFACE MOUNTED NOTCH RADIATOR WITH FOLDED BALUN

(71) Applicant: RAYTHEON COMPANY, Waltham, MA (US)

(72) Inventor: James M. Irion, II, Allen, TX (US)

(73) Assignee: Raytheon Company, Waltham, MA (US)

( * ) Notice: Subject to any disclaimer, the term of this patent is extended or adjusted under 35 U.S.C. 154(b) by 245 days.

(21) Appl. No.: 16/024,431

(22) Filed: Jun. 29, 2018

(65) Prior Publication Data

US 2019/0067823 A1 Feb. 28, 2019

Related U.S. Application Data

(60) Provisional application No. 62/551,176, filed on Aug. 28, 2017.

(51) Int. Cl.
*H01Q 13/10* (2006.01)
*H01Q 1/50* (2006.01)
(Continued)

(52) U.S. Cl.
CPC ..... *H01Q 13/10* (2013.01); *H01P 3/08* (2013.01); *H01P 5/10* (2013.01); *H01Q 1/50* (2013.01);
(Continued)

(58) Field of Classification Search
CPC .. H01Q 13/10; H01Q 21/0025; H01Q 21/064; H01Q 13/085; H01Q 21/24;
(Continued)

(56) References Cited

U.S. PATENT DOCUMENTS 5,365,244 A 11/1994 Yon et al.
5,786,792 A 7/1998 Bellus et al.
(Continued)

FOREIGN PATENT DOCUMENTS

EP 1 787 356 5/2007
WO WO 2016/099367 A1 6/2016
WO WO 2017/003374 1/2017

OTHER PUBLICATIONS

Sturdivant, "Dielectric Notch Radiator Antennas with Integrated Filtering for 5G and IoT Access," Conference Paper: Jan. 2017, IEEE Radio and Wireless Symposium, pp. 1-5.
(Continued)

*Primary Examiner* — Dameon E Levi
*Assistant Examiner* — David E Lotter
(74) *Attorney, Agent, or Firm* — Lewis Roca Rothgerber Christie LLP

(57) ABSTRACT

A notch radiator apparatus includes: a planar circuit board having a plurality of different planar layers; a balun cavity formed between two ground layers of the planar circuit board that are separated by a laminated layer; a conductive notch formed horizontally in a plane parallel to the planar circuit board by two three dimensional (3D) structures formed on a top surface of the circuit board; a stripline signal feed folded within planar circuit board layers; and a plated hole formed vertically in a plane perpendicular to the planar circuit board and extending from the stripline signal feed. The stripline signal feed electromagnetically transfer radio frequency (RF) energy into or out of the antenna notch radiator apparatus.

18 Claims, 8 Drawing Sheets

(51) Int. Cl.

| | |
|---|---|
| ***H01Q 15/24*** | (2006.01) |
| ***H01P 3/08*** | (2006.01) |
| ***H01Q 1/52*** | (2006.01) |
| ***H01Q 21/00*** | (2006.01) |
| ***H01Q 21/24*** | (2006.01) |
| ***H01Q 13/08*** | (2006.01) |
| ***H01Q 21/06*** | (2006.01) |
| ***H01P 5/10*** | (2006.01) |

(52) U.S. Cl.
CPC ..... *H01Q 1/526* (2013.01); *H01Q 13/085* (2013.01); *H01Q 15/24* (2013.01); *H01Q 21/0025* (2013.01); *H01Q 21/0075* (2013.01); *H01Q 21/064* (2013.01); *H01Q 21/24* (2013.01)

(58) Field of Classification Search
CPC .... H01Q 21/0075; H01Q 1/526; H01Q 15/24; H01Q 1/50; H01P 5/10; H01P 3/08
See application file for complete search history.

(56) References Cited

U.S. PATENT DOCUMENTS

| | | | | |
|---|---|---|---|---|
| 6,219,000 | B1 | 4/2001 | McWhirter et al. | |
| 6,995,710 | B2 | 2/2006 | Sugimoto et al. | |
| 7,057,563 | B2 | 6/2006 | Cox et al. | |
| 7,245,264 | B2 | 7/2007 | Sakakibara et al. | |
| 7,315,288 | B2 | 1/2008 | Livingston et al. | |
| 7,688,265 | B2 | 3/2010 | Irion, II et al. | |
| 7,948,441 | B2 | 5/2011 | Irion, II et al. | |
| 8,232,928 | B2 | 7/2012 | Johansen et al. | |
| 8,259,027 | B2 | 9/2012 | Isom et al. | |
| 8,350,767 | B2 * | 1/2013 | Brigham | H01Q 13/106 342/44 |
| 8,736,505 | B2 | 5/2014 | Lambert et al. | |
| 9,306,262 | B2 | 4/2016 | Puzella et al. | |
| 9,537,208 | B2 | 1/2017 | Isom | |
| 2006/0044189 | A1 * | 3/2006 | Livingston | H01Q 9/0414 343/700 MS |
| 2006/0287579 | A1 * | 12/2006 | Okada | A61B 10/06 600/156 |
| 2016/0365640 | A1 | 12/2016 | Minard et al. | |
| 2017/0331199 | A1 * | 11/2017 | Svensson | G06F 21/554 |

OTHER PUBLICATIONS

Yong-Xin et al., "Wideband Dual-Polarized Antenna with Broadband Baluns," Jan. 8, 2007, IEEE Transactions on Antennas and Propagation, vol. 55, Issue 1, pp. 1-4.

International Search Report for corresponding International Application No. PCT/US2018/041502, filed Jul. 10, 2018, International Search Report dated Sep. 6, 2018 and dated Sep. 19, 2018 (5 pgs.).

Written Opinion of the International Searching Authority for corresponding International Application No. PCT/US2018/041502, filed Jul. 10, 2018, Written Opinion of the International Searching Authority dated Sep. 19, 2018 (12 pgs.).

* cited by examiner

SURFACE MOUNTED NOTCH RADIATOR WITH FOLDED BALUN

CROSS-REFERENCE TO RELATED APPLICATIONS

This Patent Application claims the benefits of U.S. Provisional Patent Application Ser. No. 62/551,176, filed on Aug. 28, 2017 and entitled "Surface Mounted Notch Radiator with Folded PWB Balun," the entire content of which is hereby expressly incorporated by reference.

FIELD OF THE INVENTION

The disclosed invention generally relates to antennas and more specifically to surface mounted notch radiators with folded PWB baluns.

BACKGROUND

An antenna is a type of device that is adapted to transmit and/or receive electromagnetic energy. For electromagnetic energy in the microwave frequencies, numerous differing types of antenna structures have been developed. One particular type of microwave antenna is the microstrip or patch antenna. Characteristic aspects of the patch antenna may include its relatively narrow bandwidth and low physical depth profile. Another popular type of microwave antenna is the notch antenna, which includes the flared notch antenna and cross notch antenna as some variations. The notch antenna possesses a characteristically broader bandwidth than the patch antenna, yet requires a depth profile that is at least approximately ¼ wavelength at the lowest desired operating frequency. In a notch antenna, the radiation pattern is determined by the size and shape of the notch or slot in the radiating surface.

FIG. 1 shows a cross section of a conventional implementation of a tapered notch antenna. As shown, antenna array 100 includes a number of first antenna elements 112 and a number of second antenna elements that are formed between adjacent tapers 110. For example, each taper 110 may have four sides that form two first antenna elements 112 and two second antenna elements with adjacent tapers 110 (not shown). The first and second antenna elements are coupled to an antenna drive circuit (not shown) through a feed circuit 152. Feed circuit 152 is configured on a number of columns 120 that extend in a direction that is oblique to first antenna elements and second antenna elements. The first antenna elements and the second antenna elements are slotline radiators that are formed from a number of conductive tapers 110 having a square cross-sectional shape at a base 126 and are fed equally by feed circuit 152.

Connectors 154 are transmission line conductors that extend across the bases of two adjacent tapers 110 to form a balun. The balun converts unbalanced signals from antenna drive circuit to balanced signals that may be propagated through first and second antenna elements as electromagnetic energy. The posts 140 feature recessed edges below the top of the posts 140, where these recessed edges may form a balun slot between adjacent posts 140. Each column 120 may be configured with a portion of feed circuit 152, which may be a TRIMM card. The TRIMM cards may include ports that connect with the array base when the columns 120 are secured within the array base.

FIG. 2A shows a conventional Slat circuit board with etched notch and etched balun cavity. As shown, etched notch 204 and etched balun cavity 208 are formed in the Slat circuit board 202. A notch radiator is formed with a taper mouth 205 as a gap in conductive ground planes 207 with the etched balun cavity 208. An (unbalanced) transmission line feed 206, extending vertically downward, transmits electromagnetic energy to the etched notch 204 to cause radiation for the antenna. Broadband notch radiators are generally suited for Slat electronics architectures, because the slotline notch and its balun structure can be easily etched into the leading edge ground planes of vertically oriented circuit boards containing integrated transmission line feed circuits as shown in FIG. 2A.

A Slat circuit board describes an electronics packaging configuration where adjacent circuit boards are arranged vertically (on an edge) and side by side instead of stacked on top of each other like planar or panel architectures. Receive integrated multichannel modules (RIMM) and transmit/receive integrated multichannel modules (TRIMM) are both slat configurations in which radar receive or transmit/receive electronics are respectively packaged on the vertically oriented circuit boards. This way, broadband tapered notches are easily integrated into the leading edges of these circuit boards.

Notch radiators are less suited for panel electronics architectures where the conductive bodies of the notch and the balun are implemented as separate surface mounted structures extending perpendicularly from the front and back faces, respectively, of the panel containing the transmission line feed circuits. This configuration is shown in FIG. 2B.

FIG. 2B depicts a conventional antenna panel with surface mounted three dimensional (3D) notch. As depicted 3D notches 214 are (surface) mounted on top of a panel circuit board 212 and a balun lid 219 is (surface) mounted on the bottom of the panel circuit board 212. A balun cavity 218 is then formed in the space between the bottom of the panel circuit board 212 and the balun lid 219. An unbalanced transmission line feed 216 enters into the radiator horizontally instead as compared to transmission line 206 of the SLAT configuration. A key problem with the configuration of FIG. 2B is that the packaging of 3D notch and balun structures requires surface area on the upper and lower panel faces, thus reducing the available area for the packaging of supporting electronics and also creating undesirable keep out zones that inflate feed manifold complexity.

FIG. 2C shows a conventional antenna panel with surface mounted three 3D folded notch. Here, the same notch 214 is formed with the slotline balun cavity 220 rotated by 90° so that it is folded into the conductive 3D body of the surface mounted notch 214 on the upper face of the panel circuit board 224. Similar to FIG. 2B, an unbalanced transmission line feed 222 enters into the radiator horizontally. This configuration requires the formation of an overhanging lip 226 that extends from the sidewall of the notch body 214. The fabrication of this walled lip, especially for higher frequency band radiators where physical dimensions are small, increases the physical complexity of the notch body and therefore drives up the cost.

SUMMARY OF THE INVENTION

In some embodiments, the disclosed invention is an antenna notch radiator apparatus. The notch radiator apparatus includes: a planar circuit board having a plurality of different planar layers; a balun cavity formed between two ground layers of the planar circuit board that are separated by a laminated layer; a conductive notch formed horizontally in a plane parallel to the planar circuit board by two three dimensional (3D) structures formed on a top surface of the circuit board; a stripline signal feed folded within planar circuit board layers; and a plated hole formed vertically in a plane perpendicular to the planar circuit board and extending from the stripline signal feed, wherein the stripline signal feed electromagnetically transfer radio frequency (RF) energy into or out of the antenna notch radiator apparatus.

In some embodiments, the disclosed invention is a dual polarization antenna that includes: a planar circuit board having a plurality of different planar layers, wherein the planar circuit board includes a stripline layer and a folded balun layer in which, feed circuits for the orthogonal polarizations are formed; a plurality of dual polarization notches formed horizontally in a plane parallel to the planar circuit board; and a plurality of folded balun cavities form within an internal balun layer of the planar circuit board to feed the orthogonal polarizations.

In some embodiments, the disclosed invention further includes a second balun cavity formed between said two ground layers of the planar circuit board and a second notch formed by second two 3D structures mounted on the top surface of the circuit board to provide dual polarized excitation of the two notches. The two 3D structures may be surface mounted on the top surface of the circuit board and may be rectangular, curved-shaped or elliptical-shaped.

In some embodiments, the disclosed invention may further include a dielectric face sheet formed on top of the two 3D structures, is bonded to the top of the two 3D structures to increase the structural rigidity of the antenna notch radiator apparatus.

BRIEF DESCRIPTION OF THE DRAWINGS

A more complete appreciation of the disclosed invention, and many of the attendant features and aspects thereof, will become more readily apparent as the disclosed invention becomes better understood by reference to the following detailed description when considered in conjunction with the accompanying drawings in which like reference symbols indicate like components.

DETAILED DESCRIPTION

According to some embodiments of the disclosed invention, a notch radiator is implemented using a low cost assembly method that is naturally suited for planar panel architectures and which frees up considerable space on the panel.

In some embodiments, the disclosed invention folds the notch balun horizontally into the panel dielectric layer stack up. This is done in a way that requires only one thin laminate layer, creates no routing keep-out zones for manifold feed layers within the panel, and requires no surface area on the back side of the panel. In some embodiments, the taper notch is implemented as a simple rectangular cube shape that reduces fabrication complexity/cost.

Figures 1, 2B:
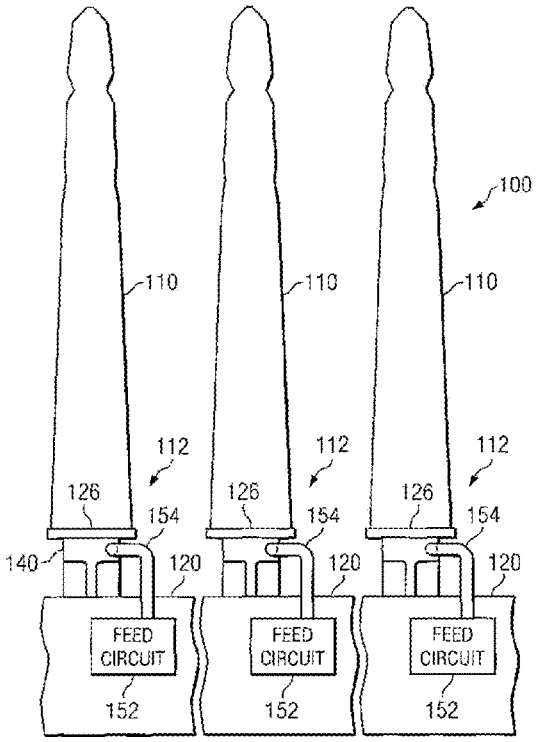
FIG. 1 (PRIOR ART)
FIG. 1 shows a conventional implementation of a tapered notch antenna.
FIG. 2B depicts a conventional antenna panel with surface mounted three dimensional (3D) notch.
Figure 2A:
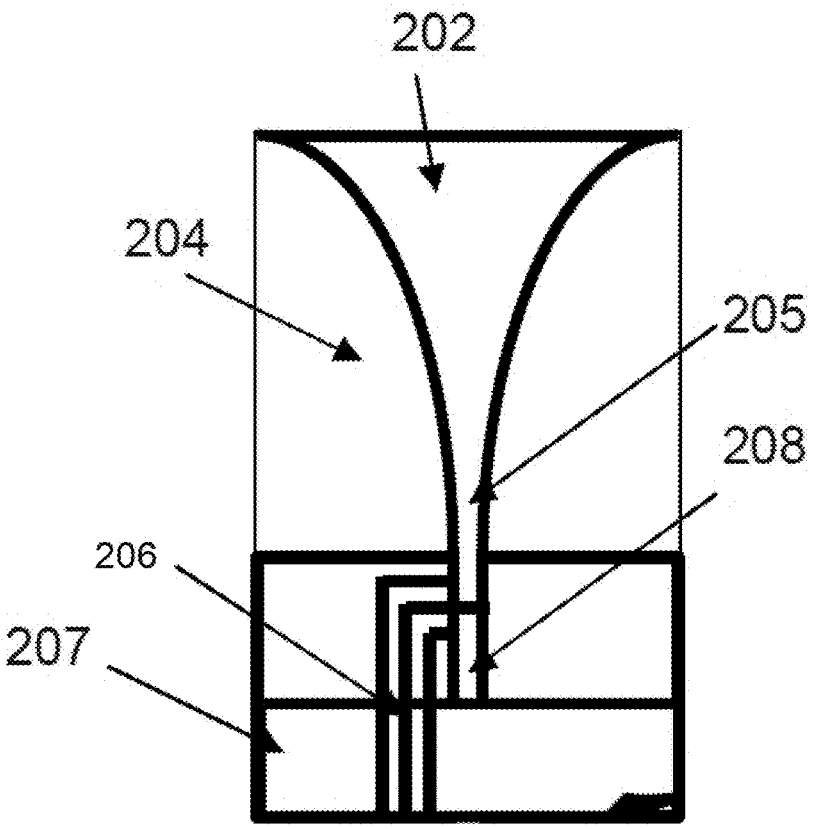
FIG. 2A (PRIOR ART)
FIG. 2A shows a conventional Slat circuit board with etched notch and etched balun cavity.
Figure 2B:
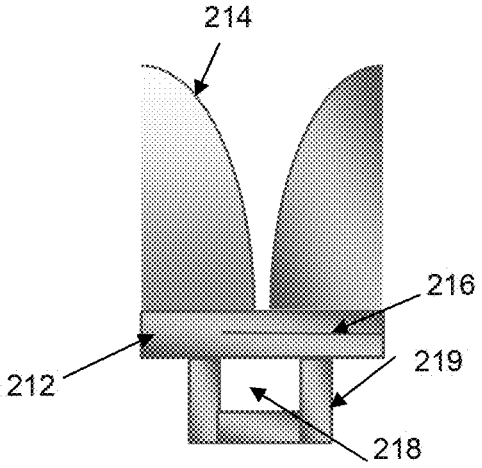
FIG. 2B (PRIOR ART)
Figure 2C:
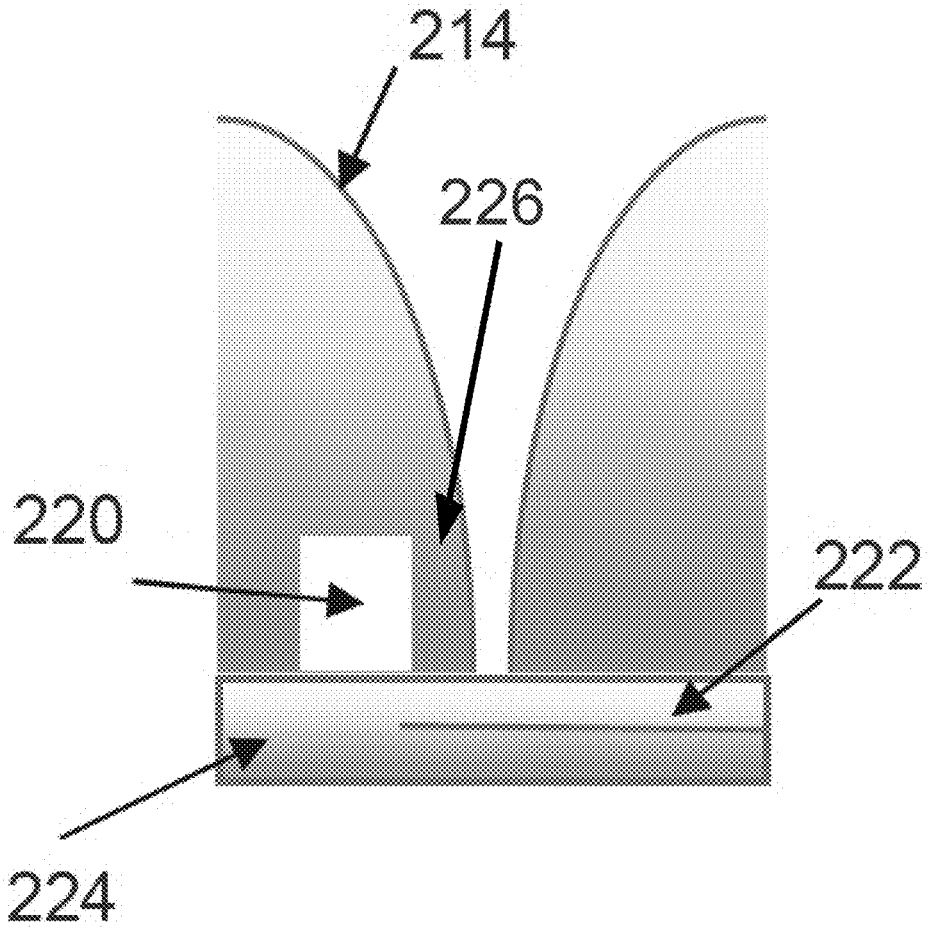
FIG. 2C (PRIOR ART)
FIG. 2C shows a conventional antenna panel with surface mounted three 3D folded notch.
Figure 3:
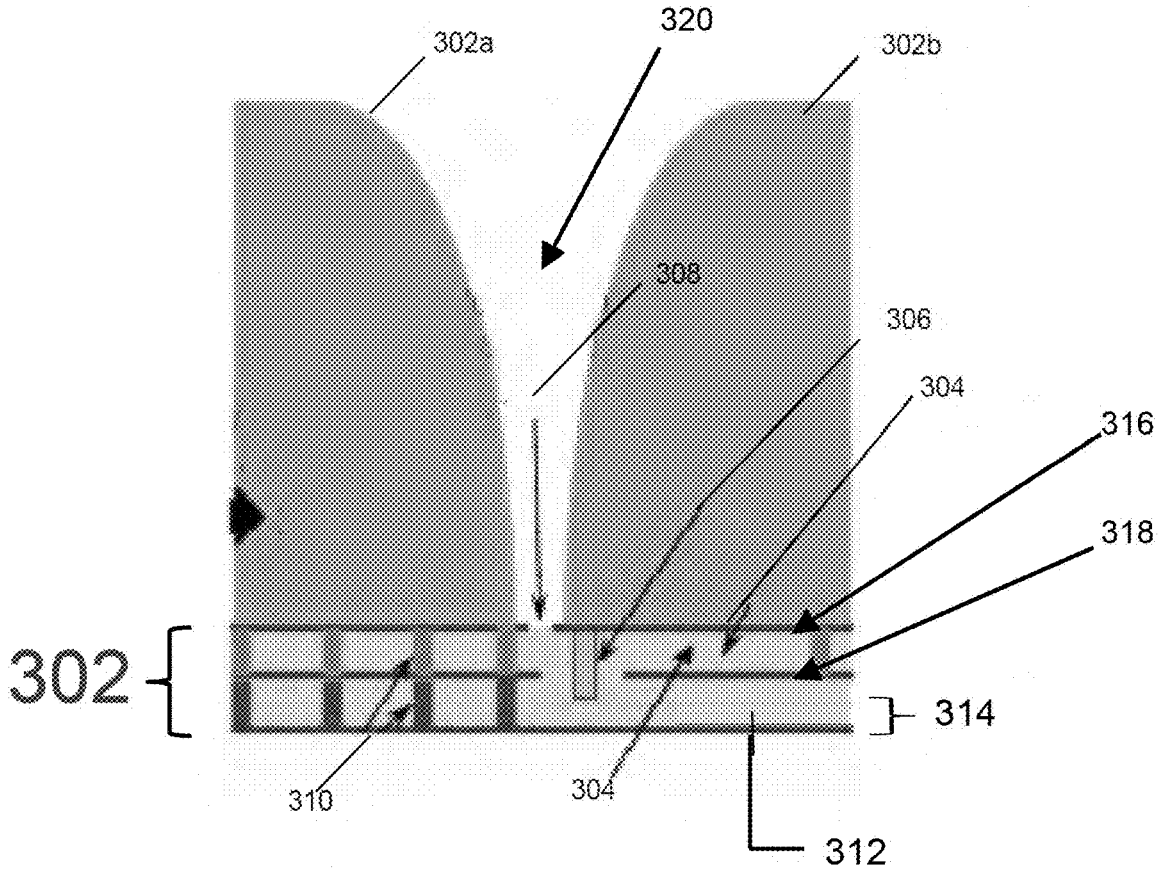
FIG. 3 depicts an exemplary panel implementation of a folded notch topology of a radiator, according to some embodiments of the disclosed invention.

FIG. 3 illustrates an exemplary folded notch topology of an antenna radiator, according to some embodiments of the disclosed invention. As shown, an equivalent folded notch feed circuit is formed horizontally within the circuit board layers of a panel antenna architecture. A radiator balun cavity 304 and stripline signal line 312 are folded horizontally within planar circuit board RF feed layers. In this context, "horizontally" means in a plane parallel to the plane of the circuit board and its layers. The gap between two ground planes 316 and 318 separated by a circuit board laminate (dielectric) layer forms the basis of the balun cavity 304. Also, "fold" as used herein is a descriptive term for the way balun cavities and/or are stripline signal line turned or bent sideways, for example, horizontally.

These components feed a tapered notch that is made from low-complexity, surface mountable, conductive 3D structures 302*a* and 302*b*. This configuration eliminates the requirement for a surface mounted balun cavity on the underside of the panel thus freeing up surface area for other components, and it removes the folded balun from the 3D notch body thus reducing its physical complexity and fabrication cost.

The horizontal extents of balun cavity 304 are controlled by the placement of grounding vias 310 connecting between ground planes. In some embodiments, the balun cavity 304 is an extension of the slotline taper mouth 320 that feeds vertically from above into the horizontal balun cavity through an etched slot 308 in the uppermost ground plane layer. Since the taper notch is located above the top ground plane 316 surface of the circuit board and the balun cavity 304 is located below the top ground plane surface of the circuit board, energy passing from the taper notch to the balun cavity 304 passes through the top ground plane surface by means of a slot opening in the ground plane. That is, one transmission line (the balun) is connected to another (the taper) through the slot in the ground plane.

As shown, a horizontal stripline feed 314 is also part of the multilayer panel stack up, formed below the balun cavity layer. This horizontal stripline feed 314 forms a transmission line that either feeds RF energy to or accepts RF energy from the radiator. The balun circuit facilitates the efficient transfer of energy between this unbalanced stripline feed and the balanced slotline taper.

A plated hole 306 (e.g., a via contact) extends vertically from the stripline signal line 312 and crosses the balun gap to electromagnetically transfer RF energy into or out of the notch radiator. In some embodiments, an array of step notch radiators are used to form an antenna array for, for example, radar and/or commercial communications when fed with this configuration of panelized folded balun. In some embodiments, all feed circuits are contained within the panel and the taper notch is a low complexity conductive 3D body that is easily attached to the top flat face of the panel circuit board, using, for example, conventional circuit board surface mount assembly methods.

In some embodiments, the folded notch radiator can also be used for a dual polarization antenna, for example, a vertically polarized and a horizontally polarized antenna. For this purpose, in some embodiments, two folded baluns, for example, similar to those depicted in FIG. 3, can be packaged within one unit cell as to provide dual polarized excitation of two orthogonal notch elements.

Figure 4:
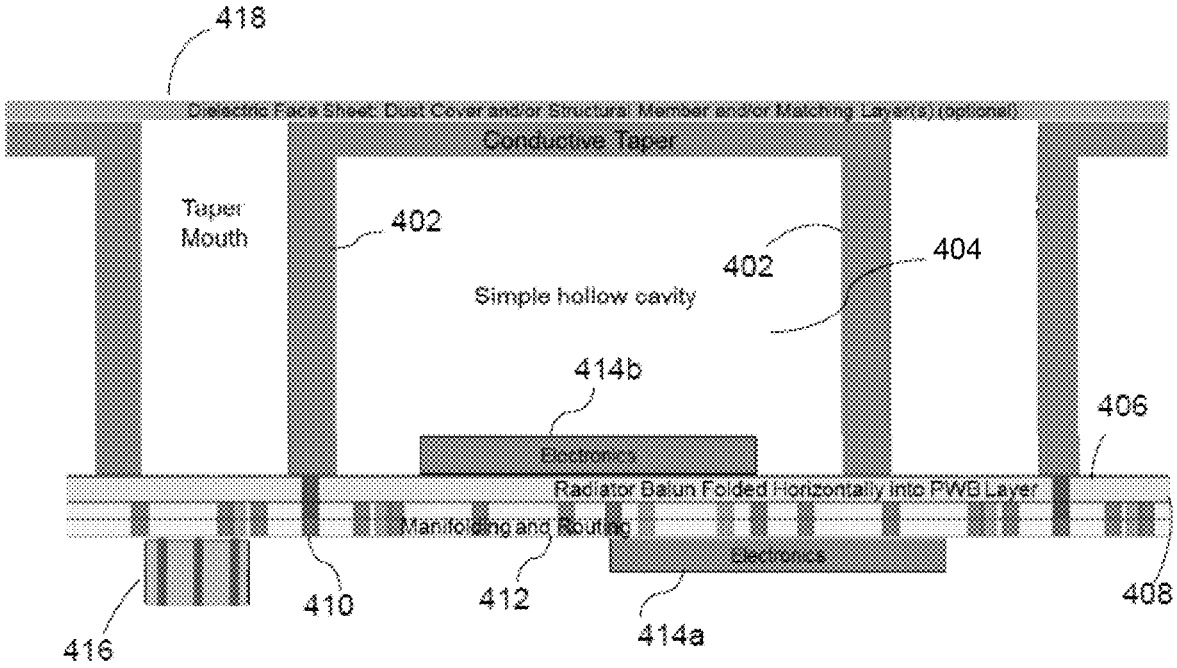
FIG. 4 is a side view of an exemplary folded notch radiator including electronics and interfaces, according to some embodiments of the disclosed invention.

FIG. 4 is a side view of an exemplary folded notch radiator including electronics and interfaces, according to some embodiments of the disclosed invention. As shown, conductive step tapers (conductive 3D structures) 402 form a hollow cavity 404 large enough to accommodate electronics 414*b* therein. Optionally, a dielectric face sheet 418 for use as a dust cover, structural member and/or matching layers, may be used on top of the top portion of conductive taper 402. In some embodiments, the step taper notch is implemented as a simple rectangular cube shape that reduces fabrication complexity and cost.

By folding the balun 408 into the horizontal layers of the panel circuit board along with the stripline feed manifold 412 and grounding vias 410, the embodiments of the disclosed invention eliminate a surface mounted balun cavity from the back side of the panel circuit board freeing up surface area that can be used for the packaging of supporting electronics 414*a* and interfaces 416. This configuration also eliminates a balun cavity within the body of the taper notch allowing the 3D conductive taper 402 to be a simplified shape that can be manufactured easily and inexpensively as a hollow cavity 404, thereby freeing up surface area on the top of the panel circuit board 406 for the packaging of other supporting electronics 414*b*. The optional dielectric face sheet 418 can be bonded to the top surface of the conductive taper to increase the structural rigidity of the entire structure.

The embodiments of the disclosed invention simplify fabrication of panelized notch arrays (lowers cost) by eliminating the need for a folded balun structure inside the 3D volume of the step notches, enabling a simplified 3D shape that is easily fabricated. The embodiments also improve panel packaging efficiency by freeing up area on top and bottom surfaces of panel since there is no radiator structure requirements, such as a balun cavity, for back side of panel and the hollow taper body serves as a cover for surface mounted electronics on front side. The disclosed invention also extends the practical frequency band to lower frequencies, minimizes thickness of circuit board stack-up needed for radiator implementation, folds the radiator balun horizontally (not vertically) within circuit board panel layers, and provides built-in electromagnetic interference (EMI) shielding and out-of-band filtering.

In some embodiments, the disclosed invention utilizes the body of the conductive taper as both a protective cover and EMI shield for feed circuitry and electronics. This structure (body) of the conductive taper may also be as a mounting surface for an optional dielectric face sheet, in some embodiments. In some embodiments, both single-pol and dual-pol radiators may be formed according to the disclosed invention.

Figure 5A:
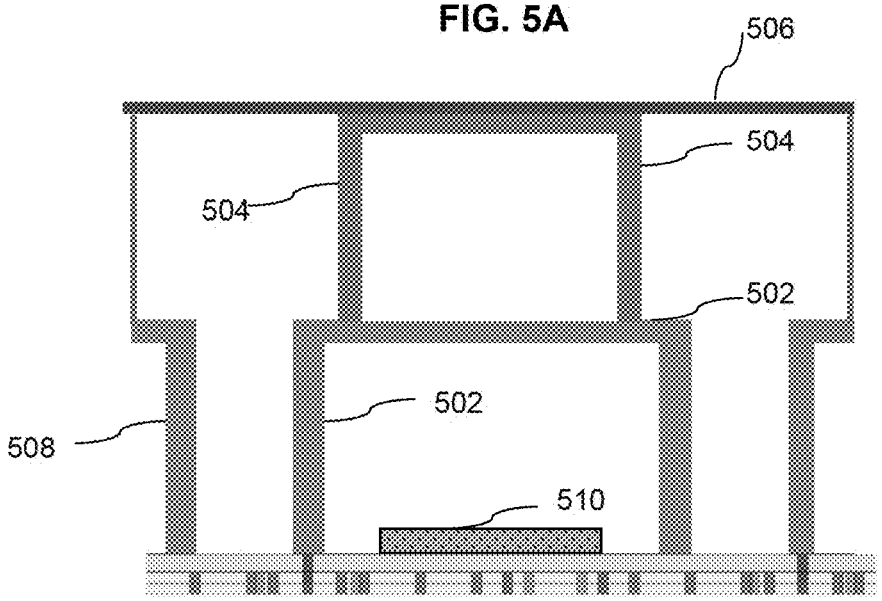
FIG. 5A shows a square or rectangular taper-shaped notch radiator, according to some embodiments of the disclosed invention.

FIG. 5A shows a square or rectangular taper-shaped notch radiator, according to some embodiments of the disclosed invention. As shown, simple but broader band tapers can be made by stacking boxes or 3D structures 502 and 504 and may include a dielectric face sheet 506 on top. In some embodiments, a multi-sections step taper made from a plurality of stacked hollow square sections (502, 504) is formed as illustrated in FIG. 5A. The square or rectangular taper-shaped structure 502 may also accommodate electronic circuits 510. This way, a simple square or rectangular taper-shaped notch antenna can be made with inexpensive surface mount lids.

Figure 5B:
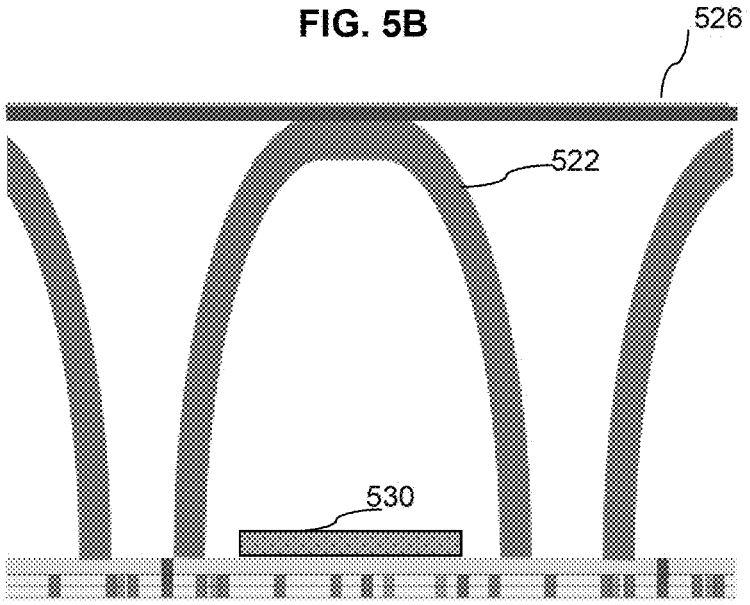
FIG. 5B illustrate a taper shape of an elliptical or curved-shaped radiator structure, according to some embodiments of the disclosed invention.

Taper shapes can take many forms based on radiator performance requirements and cost objectives. For example, FIG. 5B illustrate a taper shape of an elliptical or curved-shaped radiator structure 522 accommodating electronic circuits 530, which may include the dielectric face sheet 526 on top. In some embodiments, more advanced taper shapes can be formed using the same hollow body technique for covering electronics in order to provide increased bandwidth performance.

Figure 6:
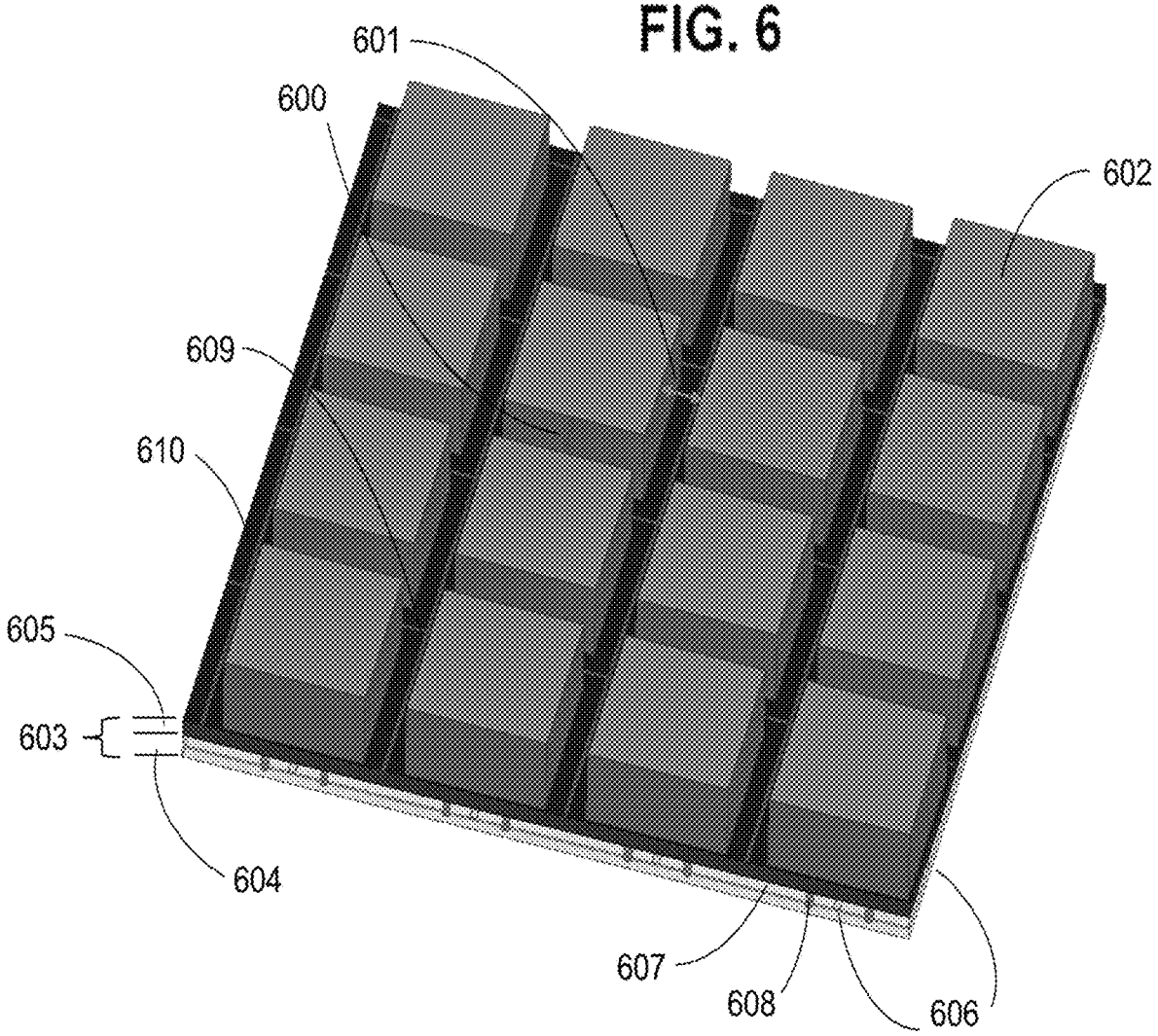
FIG. 6 depicts an exemplary symmetric square tapers for a dual polarization application, according to some embodiments of the disclosed invention

FIG. 6 depicts an exemplary array of symmetric square tapered notches for a dual polarization application, according to some embodiments of the disclosed invention. FIG. 6 illustrates an example of how a small array of dual polarization step notches are formed on a panel antenna. Orthogonal tapered notches supporting orthogonal polarizations 600 and 601 are formed by the spaces between adjacent conductive step tapered notches 602. A panel circuit board 603 includes a stripline layer 604 and a folded balun layer 605 in which, feed circuits for the orthogonal polarizations are formed. Orthogonal stripline signal lines 606 within stripline layer 604 and folded balun cavities 607 within balun layer 605 feed the orthogonal polarizations and are electrically isolated from each other, using grounding vias 608. Orthogonal slot openings 609 in the upper ground plane 610 allow RF energy to transfer between the step tapered notches 602 and the circuit board 603 layers below. This configuration also eliminates the requirement for a surface mounted balun cavity on the underside of the panel thus freeing up surface area on the bottom of the panel circuit board 603 for other components (e.g., active electronic circuits), and removes the folded balun from the 3D notch body thus reducing its physical complexity and fabrication cost. An optional dielectric face sheet, similar to the dielectric face sheet 418 may be formed on top of each tapered notch.

Conductive step tapered notches 602 form a hollow cavity large enough to accommodate electronics therein. Optionally and similar to FIG. 4, a dielectric face sheet for use as a dust cover, structural member and/or matching layers, may be used on top of the top portion of conductive tapered notches 602. In some embodiments, the notch step taper is implemented as a simple rectangular cube shape that reduces fabrication complexity/cost. By folding the balun 607 into the horizontal layers of the panel circuit board 605 along with the stripline feed manifold and grounding vias 608, these embodiments eliminate a surface mounted balun cavity from the back side of the panel circuit board 603 freeing up surface area.

It will be recognized by those skilled in the art that various modifications may be made to the illustrated and other embodiments of the invention described above, without departing from the broad inventive scope thereof. It will be understood therefore that the invention is not limited to the particular embodiments or arrangements disclosed, but is rather intended to cover any changes, adaptations or modifications which are within the scope of the invention as defined by the appended claims and drawings.

The invention claimed is:

1. An antenna notch radiator apparatus comprising:

a planar circuit board having a plurality of different planar layers;

a balun cavity formed between two ground layers of the planar circuit board that are separated by a laminated layer;

a conductive notch formed horizontally in a plane parallel to the planar circuit board by two three dimensional (3D) structures formed on a top surface of the circuit board;

a stripline signal feed folded within planar circuit board layers;

a plated hole formed vertically in a plane perpendicular to the planar circuit board and extending from the stripline signal feed, wherein the stripline signal feed electromagnetically transfer radio frequency (RF) energy into or out of the antenna notch radiator apparatus; and a slot opening in the two ground layers of the planar circuit board for passing RF energy from the notch to the balun cavity through the top ground plane surface.

2. The antenna notch radiator apparatus of claim 1, further comprising a second balun cavity formed between said two ground layers of the planar circuit board and a second notch formed by second two 3D structures mounted on the top surface of the circuit board to provide dual polarized excitation of the two notches.

3. The antenna notch radiator apparatus of claim 1, further comprising a plurality of grounding vias connecting between ground planes and positioned to control a horizontal extent of the balun cavity.

4. The antenna notch radiator apparatus of claim 1, wherein the two 3D structures form a hollow cavity to accommodate electronic circuits therein.

5. The antenna notch radiator apparatus of claim 4, wherein the two 3D structures provide electromagnetic interference (EMI) shielding for the electronic circuits.

6. The antenna notch radiator apparatus of claim 1, wherein the two 3D structures are rectangular, curved-shaped or elliptical-shaped.

7. An antenna notch radiator apparatus comprising:

a planar circuit board having a plurality of different planar layers;

a balun cavity formed between two ground layers of the planar circuit board that are separated by a laminated layer;

a conductive notch formed horizontally in a plane parallel to the planar circuit board by two three dimensional (3D) structures formed on a top surface of the circuit board;

a stripline signal feed folded within planar circuit board layers;

a plated hole formed vertically in a plane perpendicular to the planar circuit board and extending from the stripline signal feed, wherein the stripline signal feed electromagnetically transfer radio frequency (RF) energy into or out of the antenna notch radiator apparatus; and a dielectric face sheet formed on top of the two 3D structures.

8. The antenna notch radiator apparatus of claim 7, wherein the dielectric face sheet is bonded to the top of the two 3D structures to increase the structural rigidity of the antenna notch radiator apparatus.

9. An antenna array comprising the antenna notch radiator apparatus of claim 1.

10. The antenna notch radiator apparatus of claim 1, wherein the two 3D structures are surface mounted on the top surface of the circuit board.

11. The antenna notch radiator apparatus of claim 1, wherein the balun cavity is an extension of a slotline taper mouth that feeds the balun cavity through an etched slot in an uppermost ground layer of the planar circuit board.

12. The antenna notch radiator apparatus of claim 1, further comprising a second pair of 3D structures formed on top of the two 3D structures.

13. A dual polarization antenna comprising:

a planar circuit board having a plurality of different planar layers, wherein the planar circuit board includes a stripline layer and a folded balun layer in which feed circuits for orthogonal polarizations are formed;

a plurality of dual polarization notches formed horizontally in a plane parallel to the planar circuit board; and a plurality of folded balun cavities form within an internal balun layer of the planar circuit board to feed the orthogonal polarizations, wherein each of the plurality of dual polarization notches is formed by two three dimensional (3D) structures formed on a top surface of the planar circuit board.

14. The dual polarization antenna of claim 13, further comprising a plurality of grounding vias connecting between ground planes of the planar circuit board and positioned to control horizontal extents of the plurality of folded balun cavities.

15. The dual polarization antenna of claim 13, further comprising dielectric face sheets formed on top of the dual polarization notches, respectively.

16. The dual polarization antenna of claim 13, wherein each of the two 3D structures are surface mounted on the top surface of the circuit board.

17. The dual polarization antenna of claim 13, wherein each of the plurality of folded balun cavities is an extension of a slotline taper mouth that feeds said each balun cavity through an etched slot in an uppermost ground layer of the planar circuit board.

18. The dual polarization antenna of claim 13, wherein each of the two 3D structures are rectangular, curved-shaped or elliptical-shaped.

* * * * *